US011795709B2

(12) United States Patent
Cerwin

(10) Patent No.: US 11,795,709 B2
(45) Date of Patent: Oct. 24, 2023

(54) PREFABRICATED CONCRETE PIER TOP FORM

(71) Applicant: Chad William Cerwin, Durango, CO (US)

(72) Inventor: Chad William Cerwin, Durango, CO (US)

( * ) Notice: Subject to any disclaimer, the term of this patent is extended or adjusted under 35 U.S.C. 154(b) by 428 days.

(21) Appl. No.: 17/069,592

(22) Filed: Oct. 13, 2020

(65) Prior Publication Data

US 2022/0112671 A1 Apr. 14, 2022

(51) Int. Cl.

| | |
|---|---|
| ***E04G 13/02*** | (2006.01) |
| ***E01D 21/00*** | (2006.01) |
| *E01D 101/26* | (2006.01) |
| *E01D 19/02* | (2006.01) |

(52) U.S. Cl.

CPC ..... *E04G 13/028* (2013.01); *E01D 21/00* (2013.01); *E01D 19/02* (2013.01); *E01D 2101/26* (2013.01)

(58) Field of Classification Search

CPC ..... E01D 19/02; E01D 21/00; E04G 13/00; E04G 13/02; E04G 13/021; E04G 13/028

USPC ..... D25/122, 124; 249/48, 49

See application file for complete search history.

(56) References Cited

U.S. PATENT DOCUMENTS 691,704 A * 1/1902 Kennedy ..... E04G 13/028 264/225
892,592 A * 7/1908 Helm et al. ..... E04G 13/02 249/161
1,122,822 A * 12/1914 Venable ..... E04G 13/021 249/102
1,143,107 A * 6/1915 Deslauriers ..... E04G 11/00 249/48
1,199,095 A * 9/1916 Meister ..... E04G 13/02 269/37
1,208,281 A * 12/1916 Bowler et al. ..... E04G 13/021 249/169
1,224,584 A * 5/1917 Vogan ..... E04G 13/028 249/48
1,307,486 A * 6/1919 Deslauriers ..... E04G 13/021 249/157
1,313,005 A * 8/1919 Meyer et al. ..... E04G 13/021 249/49

(Continued)

FOREIGN PATENT DOCUMENTS

AT 1204 U1 * 12/1996 ..... E04G 13/028
CA 2164650 A * 6/1997 ..... E02D 27/42

(Continued)

OTHER PUBLICATIONS

Translation of CN 111021258 A. (Year: 2020).*

*Primary Examiner* — Michael Safavi
(74) *Attorney, Agent, or Firm* — FOX LAW GROUP LLC

(57) ABSTRACT

A single-use or multi-use prefabricated pier top form for topping a concrete pier comprises a hollow mold with an upper portion in the desired shape of the finished pier top, a stepped-down tapered mid portion, and a lower mating portion for mating with the pier form so that concrete can be continuously poured to fill both the pier form and the pier top form at one time. Use of the prefabricated pier top form results in substantial time and material savings because the top of the pier residing above ground can be formed at the same time as the footer and pier are formed replacing the need to form a separate pier top after the pier and footer have been filled with concrete.

6 Claims, 5 Drawing Sheets

(56) References Cited

U.S. PATENT DOCUMENTS 1,374,063 A * 4/1921 Corbett ..... E04G 13/021 249/166
1,405,934 A * 2/1922 Olson ..... E04G 13/021 249/166
1,428,953 A * 9/1922 Garlinghouse ..... E04G 11/36 249/48
1,430,376 A * 9/1922 Hopmann ..... E04G 13/021 249/219.1
1,549,811 A * 8/1925 Schissel ..... E04G 11/02 249/48
1,596,868 A * 8/1926 Brynoldt ..... E04G 11/48 249/27
1,947,413 A * 2/1934 Hay ..... E02D 5/60 249/48
2,448,883 A * 9/1948 Hall ..... E04G 13/00 249/166
3,350,049 A * 10/1967 Reiland ..... E04G 13/02 249/134
5,390,464 A * 2/1995 West ..... E04B 5/43 264/32
5,890,333 A * 4/1999 Boroviak ..... E04H 12/2292 52/294
2004/0111991 A1* 6/2004 Swinimer ..... E02D 27/42 52/294
2008/0072510 A1* 3/2008 Wells ..... E04C 3/34 52/251
2021/0054628 A1* 2/2021 Low ..... E04G 13/021

FOREIGN PATENT DOCUMENTS

CA 2742053 A1 * 12/2012 ..... E04G 13/028
CN 108252511 A * 7/2018 ..... E04G 13/023
CN 111021258 A * 4/2020 ..... E01D 21/00
DE 1409954 A1 * 12/1968 ..... E04G 13/028
DE 20012636 U1 * 2/2001 ..... E04C 3/34
FR 492386 A * 7/1919 ..... E04G 13/02
FR 2987640 A1 * 9/2013 ..... E04G 11/48
KR 20110007996 U * 8/2011 ..... E04G 13/02
KR 20130092828 A * 8/2013 ..... E04G 13/02
PT 102875 A1 * 5/2004 ..... E04G 11/10
WO WO-9803749 A1 * 1/1998 ..... E02D 5/44
WO WO-2009041958 A2 * 4/2009 ..... E02D 5/52

* cited by examiner

PREFABRICATED CONCRETE PIER TOP FORM

FIELD OF THE INVENTION

This invention relates to concrete forms for materials such as concrete, polymer concrete or the like and, in particular, to a prefabricated pier top form for creating a shape for the top of a structural pier in a shape different from a typical cylindrical shape of the structural pier itself while maintaining the intended structural integrity of the structural pier.

BACKGROUND ART

The use of structural piers made from a concrete material is well known and widely practiced in the construction industry. These piers are typically formed by pouring concrete into a prefabricated tubular form made of spirally wrapped cardboard, plastic, or other materials. A common tubular pier form is a product with a tradename Sonotube®. Filling a Sonotube® form or other tubular form with concrete creates a cylindrical pier. Further, according to most building codes, structural piers are supported by a footing. The footing, which is normally also made of concrete material, provides support for the pier and its load. Traditionally, builders used in construction wooden footing forms built on-site. Today, various types of prefabricated footing forms exist, most of which are somewhat tapered towards the top where the tubular pier form and the footing form are joined. Prefabricated pier building is quick and is generally done in one pour of concrete, which increases cost savings. The method often consists of fitting a Sonotube® form or other prefabricated tubular pier form to a prefabricated footer form thus creating a pier form assembly. Next, rebar or steel reinforcing rods are placed inside the assembly. The form assembly is then often backfilled with dirt. Finally, the structural pier is created by filling the form assembly with one pour of concrete.

The typical structural pier arrangement leaves a portion of the cylindrical concrete pier protruding from the ground. International Building Code states that the finished structural pier be at least 6" above finished grade when finished so the wood beam or post that attaches to it will be above any potential moisture. This, however, leaves a cylinder shaped unfinished structural pier look. Importantly, a homeowner or building owner may desire the pier to have a different shape other than a cylinder. This desire maybe driven by mere esthetics or the want to cover the pier with another material such as a stone material. To avoid this cylindrical look, many architects specify the entire pier be rectangle shaped to create a rectangle shaped upper portion of the pier protruding from the ground instead of a cylindrical upper portion of the pier so that either the pier could have rock or tile placed on it or the pier can be left rectangle to achieve a clean finish. Another reason for desiring a rectangle shaped upper portion of the pier protruding from the ground may be to match the pier with the same shape as a post attached above the pier, such as a rectangle 10" upper pier portion matching with an 8" rectangle wooden post.

Today, to build a rectangle pier instead of a cylindrical pier takes many more hours of on-site form work and generally two separate concrete pours, one to form a footer and then a second pour to form the rectangle pier. What is needed is a prefabricated pier top form that mates with a tubular pier form to create a desired shape for the final pier top different from the cylindrical pier itself while still allowing for the footer, the pier, and the pier top to be created with one concrete pour.

SUMMARY OF THE INVENTION

One embodiment of the present invention is a prefabricated pier top form for finishing the top of a prefabricated cylindrical pier in a shape such as a rectangle that is different from the cylindrical pier or pier created by a Sonotube® form. The pier top form allows the use of a prefabricated footer, a prefabricated tubular pier form or Sonotube® form, and the prefabricated pier top form to be filled with rebar and then with concrete in one pour to create a typical cylindrical pier but with a rectangle top or other desired shape that can be cleanly finished or finished with other materials such as stone to create an architect's desired look while maintaining the intended structural integrity of the pier.

The pier top form in one embodiment is a prefabricated form that mates with a tubular pier form, or Sonotube® form or another prefabricated concrete form such as prefabricated footer form. The footer form, tubular form, and pier top form create a structural pier form assembly into which rebar is placed as per local code and or International Building codes. The entire assembly can be backfilled as normal and filled with concrete in one pour.

The concrete pier top form does not have to be filled to the top. The pier top form could be partially filled to any desired level, typically 6" above finished grade. The pier top form can also be directly fitted to the footer if a shorter height structural pier is needed.

Once the concrete has cured, the pier top form can be removed to expose the clean concrete shape of the pier top form. Typically, the pier top form will have a rectangle shape to create a structural pier with a rectangle shape top or upper portion, but the pier top form may have a pyramid shape, another quadrilateral shape, rock shape, or other custom shape to meet architectural specifications.

The prefabricated pier top form could be either a single-use form manufactured from material like cardboard or plastic, or the pier top form could be manufactured from a metal material to be reused. The pier top form may be made to any height or width with a lower portion sized to mate a typical 8, 10, or 12 inch diameter tubular form such as a form manufactured by Sonotube®. The pier top form may be fixed to the tubular pier form using any common method such as using screws to secure the two forms together.

The embodiments of the present invention will be described with reference to the drawings FIGS. 1-6. The embodiments described below are intended as exemplary, and it will be appreciated by those skilled in the art that the present invention is not limited to any particular the arrangement described below.

BRIEF DESCRIPTION OF THE DRAWINGS

Embodiments of the present invention are illustrated by way of examples and are not limited to the accompanying drawings.

DETAILED DESCRIPTION OF INVENTION

Figure 1:
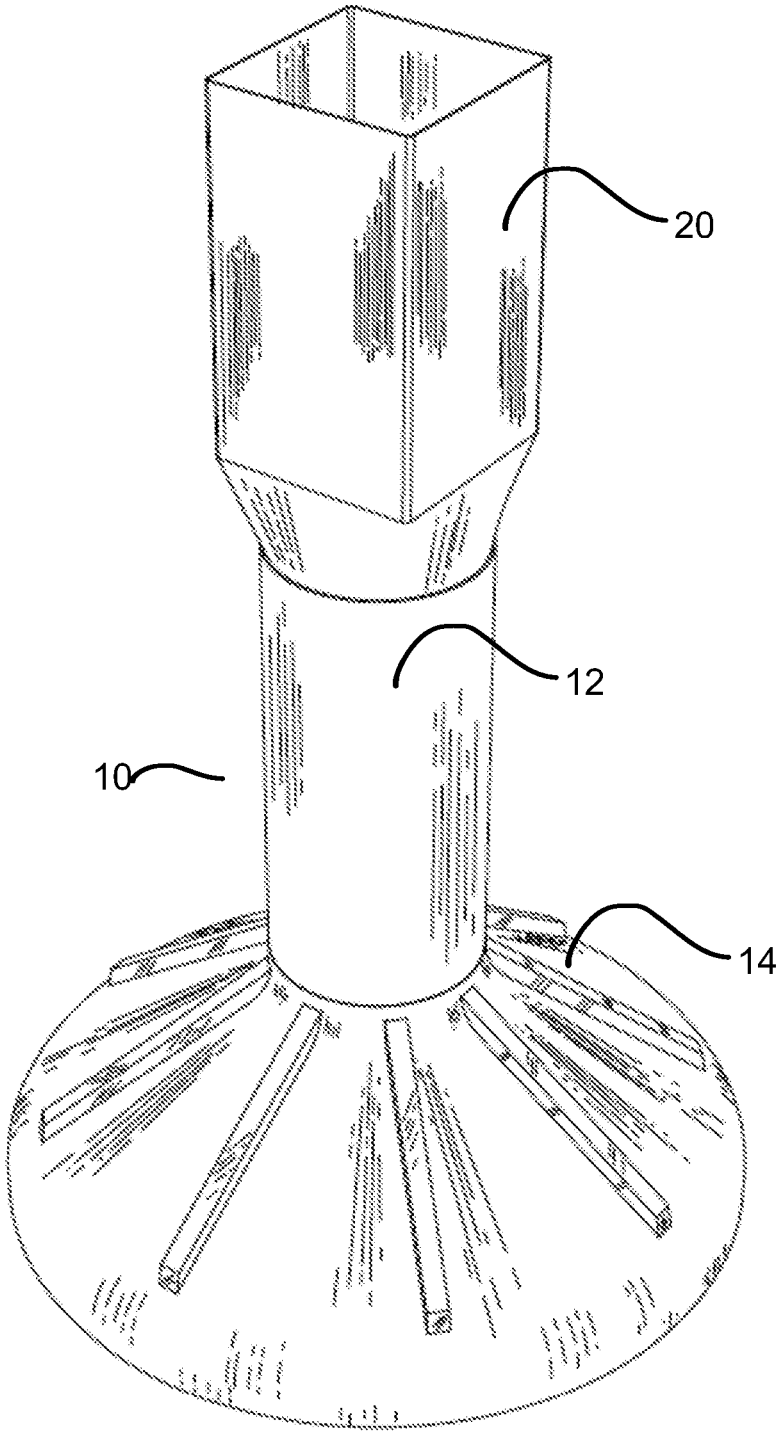
FIG. 1 shows a perspective view of an embodiment of the pier top form coupled to a tubular form and a footer form creating a structural pier form assembly.
Figure 3:
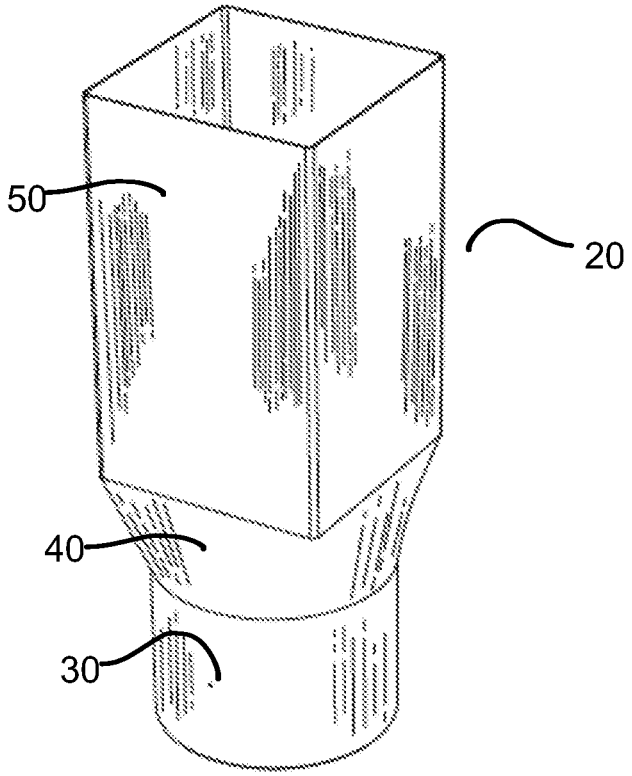
FIG. 3 shows a perspective view of the embodiment of the pier top form shown in FIG. 1.
Figure 4:
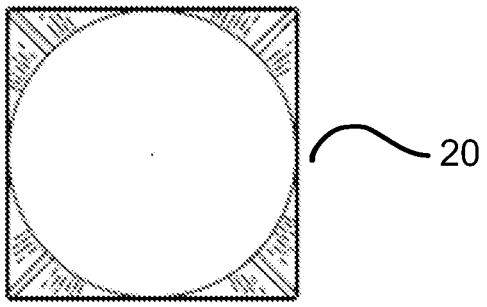
FIG. 4 shows a top view of the embodiment of the pier top form shown in FIG. 3.

Referring now to the figures, FIG. 1 shows a structural pier form assembly 10 with an embodiment of the prefabricated pier top form 20 coupled to a tubular pier form 12 and a footer form 14. Referring to FIG. 3, the pier top form 20 has a tubular lower section 30 configured to couple with the tubular pier form 12, a tapered mid-section 40 that transitions from the tubular shape of the lower section 30 to a desired shape of pier top and an upper section 50 that creates the desired shape of the top of the structural pier. A structural pier form assembly 10 is created by securing the footer form 14 to the pier form 12 and securing the pier top form 20 to the pier form 12. The structural pier can then be formed by placing rebar into the structural pier form assembly 10 and then filling the assembly in one pour with concrete.

Figure 5:
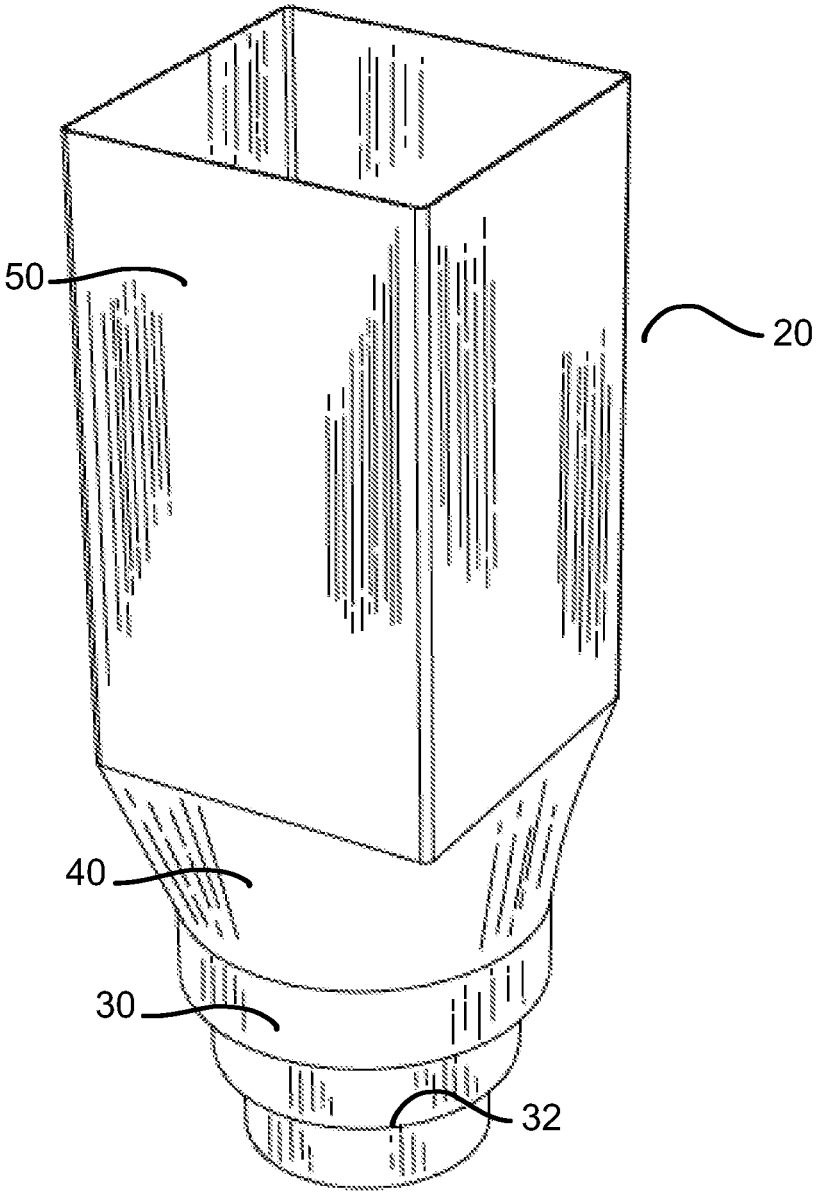
FIG. 5 shows a perspective view of an alternative embodiment of the pier top form with a stepped mating area.

Referring to FIG. 5, the lower section 30 of the prefabricated pier top form 20 may be comprised of a stepped mating area 32 to couple with several different optional diameter tubular pier forms. The stepped mating area 32 may fit over or inside the tubular pier form 12. In another embodiment, the lower section 30 of the prefabricated pier top form 20 may be comprised of a collar mating section that couples with a matched size tubular pier form 12. In still another embodiment, the lower section 30 of the pier top form 20 is comprised of a mating area that matches the configuration of a pier form for example a rectangle mating area 35 that matches a rectangle pier form 13. In any embodiment, the pier top form 20 may be secured to the pier form 12 or another form by way of any common method including screws, other fasteners, glue, etc.

Figure 2:
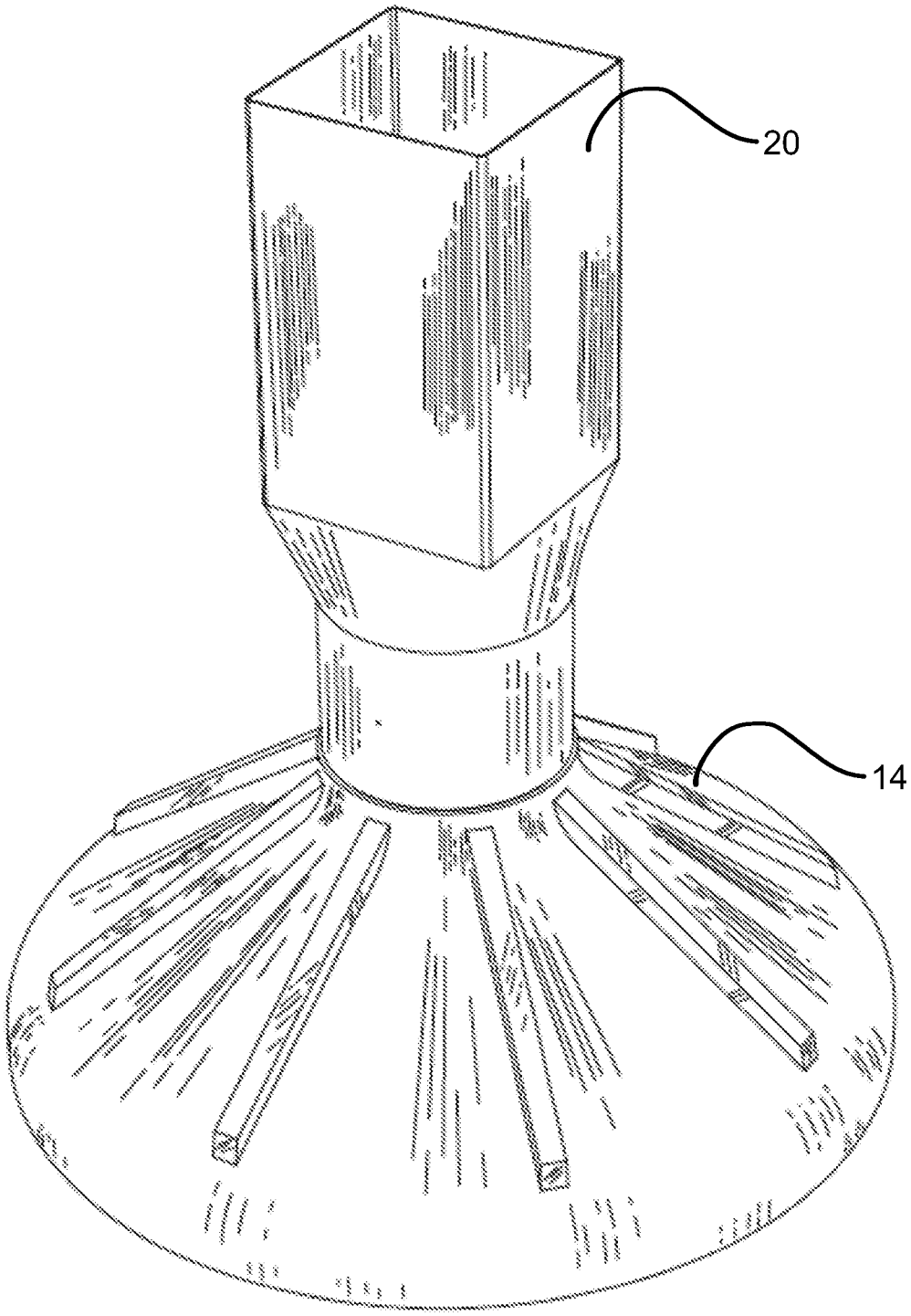
FIG. 2 shows a perspective view of an embodiment of the pier top form coupled a footer form creating a structural pier form assembly

The pier top form 20 can be fully or partially filled with concrete to achieve the desired finished height. The pier top form 20 could be partially filled to any desired level. Typically, the pier top form 20 will be filled to a resulting height of six inches above finished grade. In some applications where a shorter overall structural pier is desired, the pier top form 20 can also be directly fitted to the footer form 14 as shown in FIG. 2.

The tapered mid-section 40 transitions between the lower section 30 that mates to the pier form 12 and the upper section 50 that forms the desired shape of the pier top. The taper section 40 in one embodiment smoothly transitions between the two other sections permitting concrete to flow through the pier top form 20 to the pier form 12. In another embodiment, the pier top form 20 transition section 40 comprises a step or other shape as required to maintain flow of concrete through the pier top form 20 as it is being filled. The transition section 40 may also have securing portions for securing rebar or other structural members inside the pier top form 30.

Figure 6:
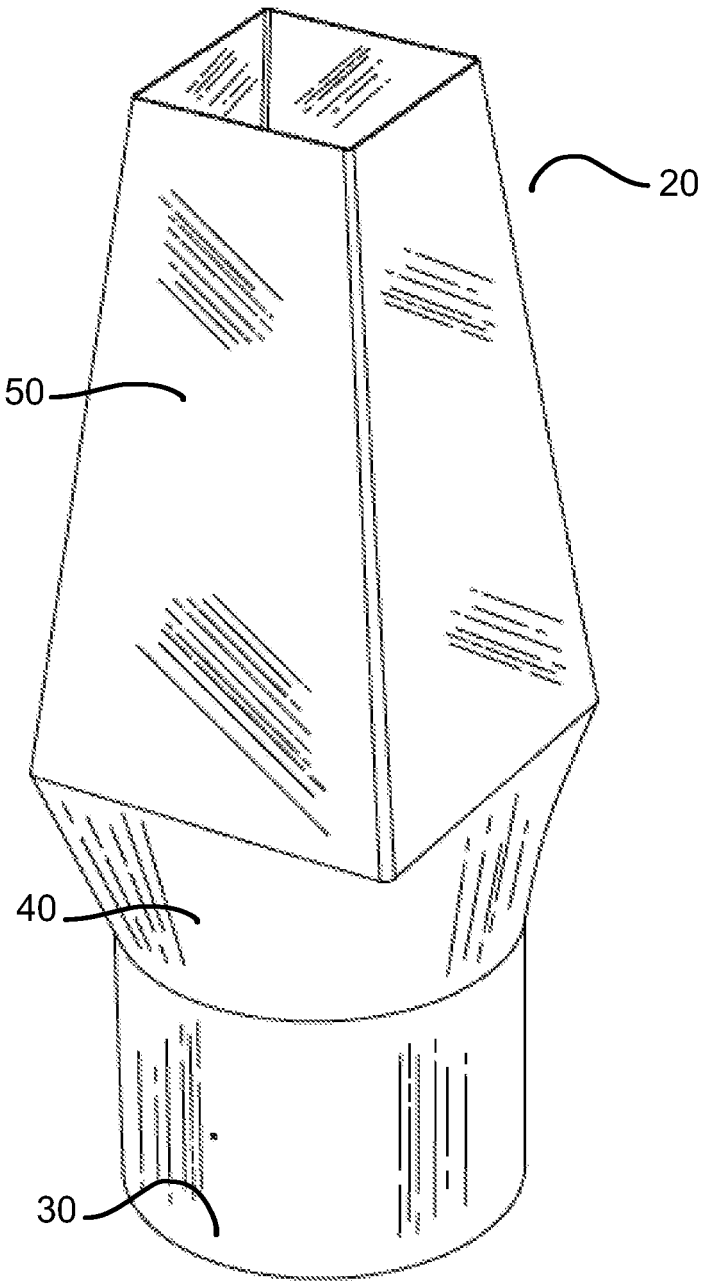
FIG. 6 shows a perspective view of a truncated square pyramid embodiment of a pier top form.

The upper section 50 of the pier top form 20 forms the desired shape of the top of the structural pier. FIGS. 1-5 show the upper section 50 of the pier top form 20 in the shape of a rectangle so that the resulting top of the structural pier formed by the structural pier form assembly 10 will be rectangle shaped. FIG. 6 shows the upper section 50 of the pier top form 20 in the shape of a truncated square pyramid so that the resulting top of the structural pier formed by the structural pier form assembly 10 will be square pyramid shaped. The upper section 50 could also be in a shape that appears to represent a rock. One of skill in the art will understand that the upper section 50 could be in the form of several different shapes to meet the desires for different features and or specifications.

The prefabricated pier top form 20 may be made from various materials including cardboard, plastic, or metal. In an embodiment of the invention, the pier top form 20 is made from cardboard. Following pouring concrete to create the pier and the setting of the concrete, the cardboard pier top form 20 may be cut away from the concrete exposing a clean pier top.

In another embodiment of the invention, the prefabricated the pier top form 20 is divided into first and second sections couple by a hinge. The first and second sections are held shut by a closure. The hinge permits easy removal of the pier top form 20 after concrete has been poured to form a structural pier. One or more, clasps or other structures may be used to hold the pier top form 20 closed as part of the structural pier form assembly 10 prior to pouring concrete.

It will be appreciated by those skilled in the art that the present invention is not limited to any particular the arrangement described above or below.

What is claimed is:

1. A structural pier form comprising:

a prefabricated footer form configured to be backfilled with dirt having a tubular upper opening;

a prefabricated tubular pier form having a lower opening and an upper opening, the lower opening coupled to the tubular upper opening of the prefabricated footer form; and a prefabricated pier top form comprising;

a tubular lower section having a stepped mating area with multiple steps configured to mate several different sizes of the prefabricated tubular pier form and coupled to the upper opening of the prefabricated tubular pier form;

a tapered mid-section that transitions outwardly from the lower section; and an upper section with walls extending from the tapered mid-section configured to create a shape of the top of the structural pier, wherein the walls of the upper section of the prefabricated pier top form create a shape at the top of the structural pier form different from the shape of the prefabricated tubular pier form.

2. The structural pier form of claim 1 wherein the walls of the upper section of the prefabricated pier top form create the shape of a rectangle.

3. A method for creating a structural pier comprising:

creating a structural form assembly by setting a prefabricated footer form in the desired location;

securing a prefabricated tubular pier form to the prefabricated footer form;

securing a prefabricated pier top form to the prefabricated tubular pier form, the prefabricated pier top form comprising a tubular lower section having a stepped mating area with multiple steps designed to mate several different sizes of the prefabricated tubular pier form and configured to mate with the upper section of the prefabricated tubular pier form, a tapered mid-section that transitions outwardly from the lower section; and an upper section with walls extending from the tapered mid-section to create a shape that is a different than the tubular lower section of the pier top form;

placing rebar within the structural form assembly; and filling the footer form, the pier form, and the pier top form with concrete in one pour.

4. The method of claim 3 wherein the prefabricated pier top form is constructed of plastic.

5. The method of claim 3 wherein the walls of the upper section of the prefabricated pier top form create the shape of a rectangle.

6. The method of claim 3 wherein the walls of the upper section of the prefabricated pier top form create the shape of a truncated square pyramid.

* * * * *